US007100217B2

(12) United States Patent
Panzenböck et al.

(10) Patent No.: US 7,100,217 B2
(45) Date of Patent: Sep. 5, 2006

(54) UPPER BODY PROTECTOR FOR PROTECTING PERSONS FROM COMPRESSION TRAUMA

(76) Inventors: Peter Panzenböck, Hans-Sachs-Gasse 10 A-8010, Graz (AT); Kurt Hilgarth, Packerstrasse 92D A-8054, Graz/Pirka (AT)

( * ) Notice: Subject to any disclaimer, the term of this patent is extended or adjusted under 35 U.S.C. 154(b) by 0 days.

(21) Appl. No.: 11/032,482

(22) Filed: Jan. 10, 2005

(65) Prior Publication Data

US 2005/0210569 A1 Sep. 29, 2005

Related U.S. Application Data

(63) Continuation of application No. PCT/AT03/00191, filed on Jul. 8, 2003.

(30) Foreign Application Priority Data

Jul. 8, 2002 (AT) ..... GM455/2002

(51) Int. Cl.
*A41D 13/00* (2006.01)

(52) U.S. Cl. ..... 2/463

(58) Field of Classification Search ..... 2/462, 2/463–465, 456, 467, 102, 44, 45, 268, 908, 2/2.5

See application file for complete search history.

(56) References Cited

U.S. PATENT DOCUMENTS 3,514,786 A 6/1970 Terwilliger
3,878,561 A 4/1975 Winiecki
4,425,667 A 1/1984 Harrison
5,557,802 A * 9/1996 Wickert ..... 2/462
5,623,729 A * 4/1997 Chen ..... 2/461
5,978,961 A 11/1999 Barker
6,230,333 B1 * 5/2001 Umeda ..... 2/463

FOREIGN PATENT DOCUMENTS

FR 812.317 5/1937
FR 2 738 996 A1 3/1997
GB 2 371 468 A 7/2002

* cited by examiner

*Primary Examiner*—Tejash Patel
(74) *Attorney, Agent, or Firm*—Laurence A. Greenberg; Werner H. Stemer; Ralph E. Locher

(57) ABSTRACT

An upper body protector is configured to protect a person from compression trauma. The protector is formed with rigid protection elements and shoulder straps on the protection elements. In order to create one such upper body protector which offers not only especially high protection against compression of the upper body, but is also as comfortable to wear as possible and does not limit the freedom of movement of the carrier, the shoulder straps and the protection elements together form at least two cage elements of fiber-reinforced plastic material. The cage element are formed with at least one tubular body consisting of a fiber-reinforced plastic material, especially a carbon fiber reinforced plastic material.

25 Claims, 9 Drawing Sheets

UPPER BODY PROTECTOR FOR PROTECTING PERSONS FROM COMPRESSION TRAUMA

CROSS-REFERENCE TO RELATED APPLICATION

This is a continuing application, under 35 U.S.C. § 120, of copending international application PCT/AT2003/000191, filed Jul. 8, 2003, which designated the United States; this application also claims the priority, under 35 U.S.C. § 119, of Austrian application GM 455/2002, filed Jul. 8, 2002; the prior applications are herewith incorporated by reference in their entirety.

BACKGROUND OF THE INVENTION

Field of the Invention

The invention relates to an upper body protector for protecting persons from compression trauma, comprising rigid protection elements and shoulder supports arranged on these rigid protection elements.

In many occupational and also sports activities, individuals find themselves at increased risk of accidents in which particularly high compression forces act on the upper body. For example, in tunnel construction or in trench construction, rocks may fall on the person working there, resulting in large amounts of rock landing on his upper body and destroying the organs of the chest and abdomen and making it impossible to breathe because of the particularly great pressure. In sports too, however, for example in motorcycling accidents or the like, enormous compression forces may affect the area of the upper body. Detailed analysis of riding accidents with fatal outcomes has also revealed that, in falls from horses, the horse very often lands on top of the rider. The enormous compression trauma damages the organs of the chest and important organs of the abdomen, causing the rider to bleed to death.

While in many activities and some sports a helmet for head protection is already obligatory, protective means for the upper body are used in only very few situations. Moreover, protective jackets used presently are in most cases unable to protect the upper body from particularly high compression forces and thus are unable to prevent or reduce injuries to the organs of the chest and abdomen.

For example, U.S. Pat. No. 5,978,961 describes a protective jacket for workers in trench construction and tunnel construction, which jacket has rigid protection elements in the form of two shell-like elements which are connected to shoulder supports in the from of straps. Such a protective jacket is relatively heavy, however, and provides the person wearing it with very limited freedom of movement. Moreover, the shoulder region and the upper part of the trunk is protected only marginally from high compression forces, so that injuries can occur here also.

Another protector for the upper body, in particular of motorcyclists or rodeo riders, is known from U.S. Pat. No. 4,425,667, where rigid protection elements protect the upper body and abdomen region from impacts. Here, rigid protection elements of plastic are arranged spaced apart from one another on a soft inner jacket. However, this does not provide a stable envelope around the upper body that would be able to withstand high compression forces.

Finally, U.S. Pat. No. 3,878,561 discloses a protective jacket for motorcyclists, which jacket can be composed of interconnected protection elements made of fiber-reinforced plastic. In addition, lateral tubes serving to protect the head and neck are connected to the protective jacket. The freedom of movement of the wearer of this protective jacket is very much restricted, however, for which reason this protector is suitable only for specific applications.

SUMMARY OF THE INVENTION

It is accordingly an object of the invention to provide an upper body protector, which overcomes the above-mentioned disadvantages of the heretofore-known devices and methods of this general type and which is configured to protect the upper body from particularly high compression forces and is as incompressible as possible. Also, the upper body protector should be as light as possible and limit the wearer's freedom of movement as little as possible. Finally, it should be simple and inexpensive to produce, so that widespread application is ensured in a variety of fields.

With the foregoing and other objects in view there is provided, in accordance with the invention, an upper body protector for protecting a person from compression trauma, comprising:

substantially rigid protection elements and shoulder supports disposed on the protection elements, the protection elements and the shoulder supports together forming two cage parts to be arranged mirror-symmetrically about a vertical plane of symmetry of the person to be protected;

the cage parts extending from a front of an upper body to a back of the upper body and being connected to one another in a use position; and each of the cage parts being formed of a one-piece, substantially rigid, continuous structure of fiber-reinforced plastic.

In other words, the objects of the invention are achieved by the fact that the shoulder supports form, together with the protection elements, two (or more) one-piece cage part made of fiber-reinforced plastic. By way of the continuous shoulder supports and protection elements, a particularly high degree of protection in the upper area of the trunk is achieved. Instead of very uncomfortable protective jackets with full-surface protectors, the upper body protector forming the subject of the invention has at least one one-piece cage part comprising both a shoulder support and also protection elements. The use of fiber-reinforced plastic combines the properties of low weight with those of particularly high strength. The upper body protector forming the subject of the invention is especially robust and withstands particularly high compression forces and can thus save the life of the person wearing the upper body protector. By using a fiber-reinforced plastic on the one hand and by means of the cage-like structure on the other, the upper body protector is also light and comfortable to wear and limits freedom of movement only slightly. In contrast to known protectors which only provide impact protection in the event of falls, the upper body protector forming the subject of the invention also prevents compression of the chest and injury to the organs of the chest and abdomen.

The cage part is advantageously made up of at least one tubular body of fiber-reinforced plastic. A tubular body arranged correspondingly around the upper body and forming the cage part of the protector creates an extremely robust structure. If the upper body protector is compressible only to a very slight extent, it can also be fitted very close to the upper body, which on the one hand enhances wearing comfort and on the other hand minimizes the risk of injury since the upper body inside the protector cannot strike against the cage part.

According to a further feature of the invention, the tubular body forming the cage part has a flat cross section, preferably an oval cross section. A tubular body with oval cross section can easily be arranged around the upper body and affords a relatively high degree of stability.

The tubular body can comprise a core around which the fiber-reinforced plastic is disposed.

The core can, for example, be formed by a foam material around which, upon production of the protector, the fiber fabric embedded in the plastic resin, for example glass fiber fabric or carbon fiber fabric, is wound and thereafter arranged in a suitable mold. The arrangement then undergoes thermal and pressure treatment, which results in hardening of the resin.

Alternatively, the core can also be made of a plastically deformable material of light weight, for example aluminum or titanium, around which in turn the resin-impregnated fabric is wound. Finally, hardening of the arrangement can be achieved without using molds that are expensive and difficult to produce. Moreover, a core, for example of aluminum, provides greater safety from shattering of the arrangement under excessively high compression forces.

Theoretically, the upper body protector can be made from just one cage part which is pulled over the head in a manner similar to a pullover. To permit this, the openings for the head and arms in the cage part must be made suitably large, and the circumference of the protector must be made significantly larger than the upper body of the person to be protected. The invention herein, however, is defined with two or more cage parts that are connected to one another in the use position of the protector. In this case, a substantially better accuracy of fit can be achieved, and thus also a higher degree of protection. In addition, it is much easier to place the novel upper body protector in its use position on the person to be protected.

The cage parts are advantageously arranged on both sides of a vertical plane of symmetry of the person to be protected and are essentially mirror-symmetrical with respect to this plane of symmetry. The cage parts thus form a protector part protecting the left side of the upper body and a protector part protecting the right side of the upper body. In production terms, however, this also affords advantages in respect of stability.

The cage parts are connected releasably to one another at at least one connection point, preferably on the front, by means of closure elements. In this way, it is easy to pull the upper body protector on and off. The closure elements can be formed by straps, clasps or the like. Of course, it is possible for all the connection elements to be connected releasably to one another by such closure elements. However, this increases the effort involved in pulling the upper body protector on and off since all the closure elements than have to be closed or opened.

The two cage parts can be connected to one another at a connection point, preferably on the back, by way of a hinge. In this way, the upper body protector can be pulled on by means of the connection elements being closed/opened at a connection point, preferably on the front, and by the cage parts being folded open or closed like a hinge. The hinge can be designed in various ways, for example by a strap arranged in the form of a figure eight or by suitable elements connected to the cage parts.

To avoid the cage parts shifting relative to one another, they can have teeth or the like at the connection points. It is essential to avoid such displacements since otherwise the upper body may be compressed and the organs of the upper body and abdomen may consequently be damaged. The teeth or the like can be configured in various ways.

According to one embodiment, two symmetrical cage parts are provided for the left side and for the right side of the upper body, each cage part being formed by a half tire which, in the use position, extends in the lower rib region from the back to the front of the upper body and whose front end is connected to the shoulder support via a connecting bridge situated alongside the sternum, which shoulder support is connected to the other end of the half tire via a connecting bridge extending on the back alongside the spinal column. Such a construction of the upper body protector affords a particularly high degree of protection from compression trauma while at the same time providing an especially high level of wearing comfort, because the opening under the arms is made especially large. This construction is particularly suitable for use by riders taking part in equestrian three-day events, since in this type of sport it is necessary to have especially great mobility. The upper body protector when used by a rider is intended to protect the rider from high compression forces caused by the horse falling on the rider, for which reason the large opening under the arms does not represent any increased risk. At most, injuries may occur in this area through being struck by the horse's hooves or the like, which injuries can in turn be avoided by suitable additional protective elements.

The cage part is provided with a cushioning layer, for example made of foam material, at least on the side directed toward the upper body in the use position. This enhances the wearing comfort and additionally serves to reduce and distribute the forces acting on the body. The foam materials can be selected according to the particular requirements.

The cage part, together with the optional cushioning layer, can be enclosed by a covering, for example of a fabric or the like.

Optimal properties in respect of strength and low weight are achieved by using carbon fibers for the plastic forming the cage part. Such carbon fiber-reinforced plastics, as are also used in motor sports or aviation, are especially stable.

As has already been mentioned above, additional plastic parts can be attached to the at least one cage part, said additional plastic parts serving, for example, to protect the shoulders, the spinal column or unprotected areas of the upper body.

These plastic parts can be made of thermoplastics, preferably processed by injection molding. It is of course possible also to use fiber-reinforced plastics for these parts.

The tubular body forming the cage part can have surface structures, for example ribs or the like, intended to provide increased strength. These structures for increased strength are relatively easy to produce when using fiber-reinforced plastics and can be configured in accordance with the particular requirements.

According to a further feature of the invention, the tubular body is incorporated into a plastic shell, and the side of the plastic shell directed toward the upper body in the use position is provided with a cushioning layer, for example made of foam material. In this way, the particularly stable tubular bodies are incorporated in a plastic armor which is pulled on like a jacket.

A layer of fabric can be arranged on the side of the plastic shell directed away from the upper body in the use position. The upper body protector thus has the outward appearance of an item of clothing.

Other features which are considered as characteristic for the invention are set forth in the appended claims.

Although the invention is illustrated and described herein as embodied in an upper body protector for protecting persons from compression trauma, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1A:
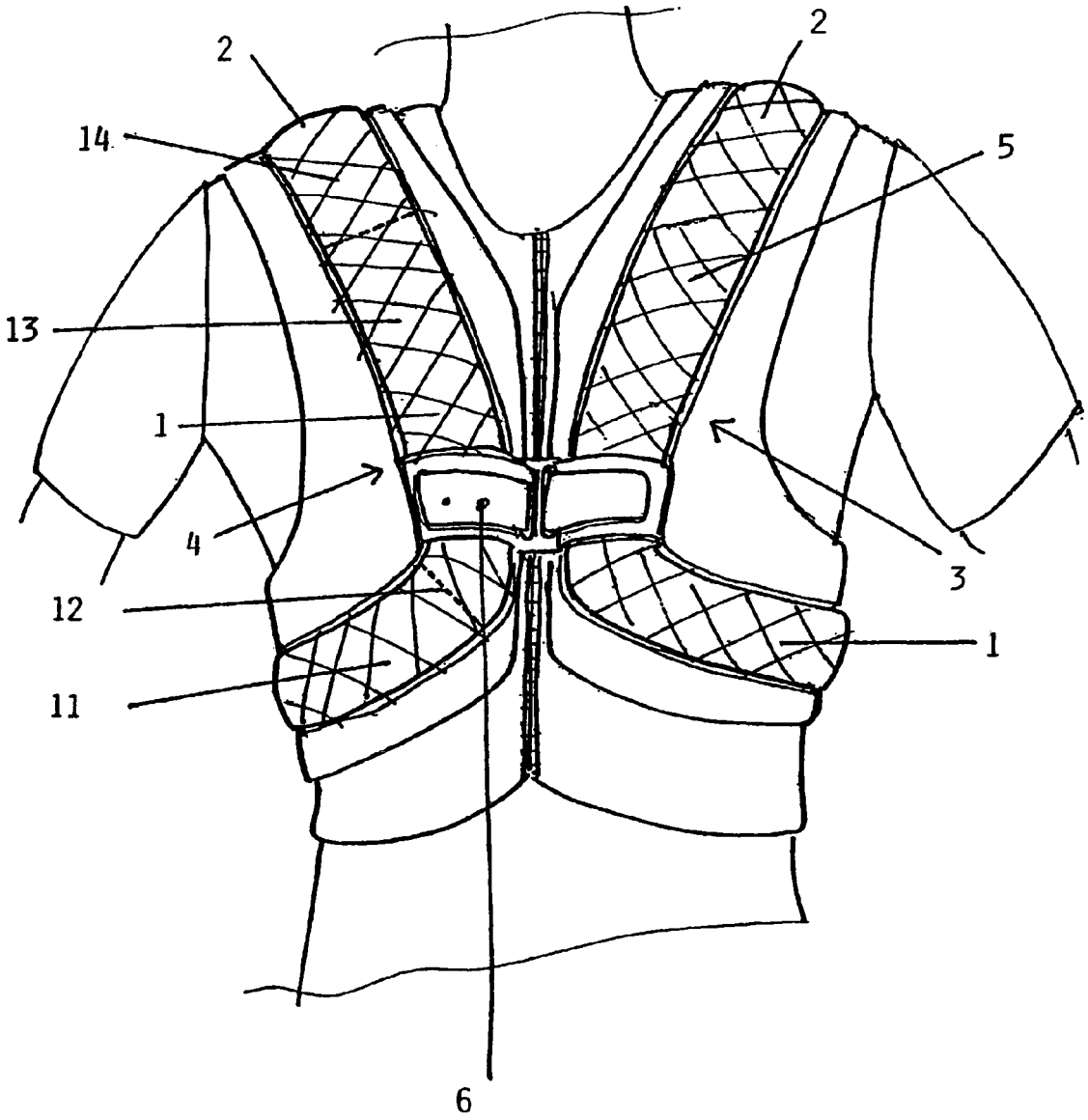
FIGS. 1A and 1B show a front view and a rear view of an embodiment of the upper body protector according to the invention.
Figure 1B:
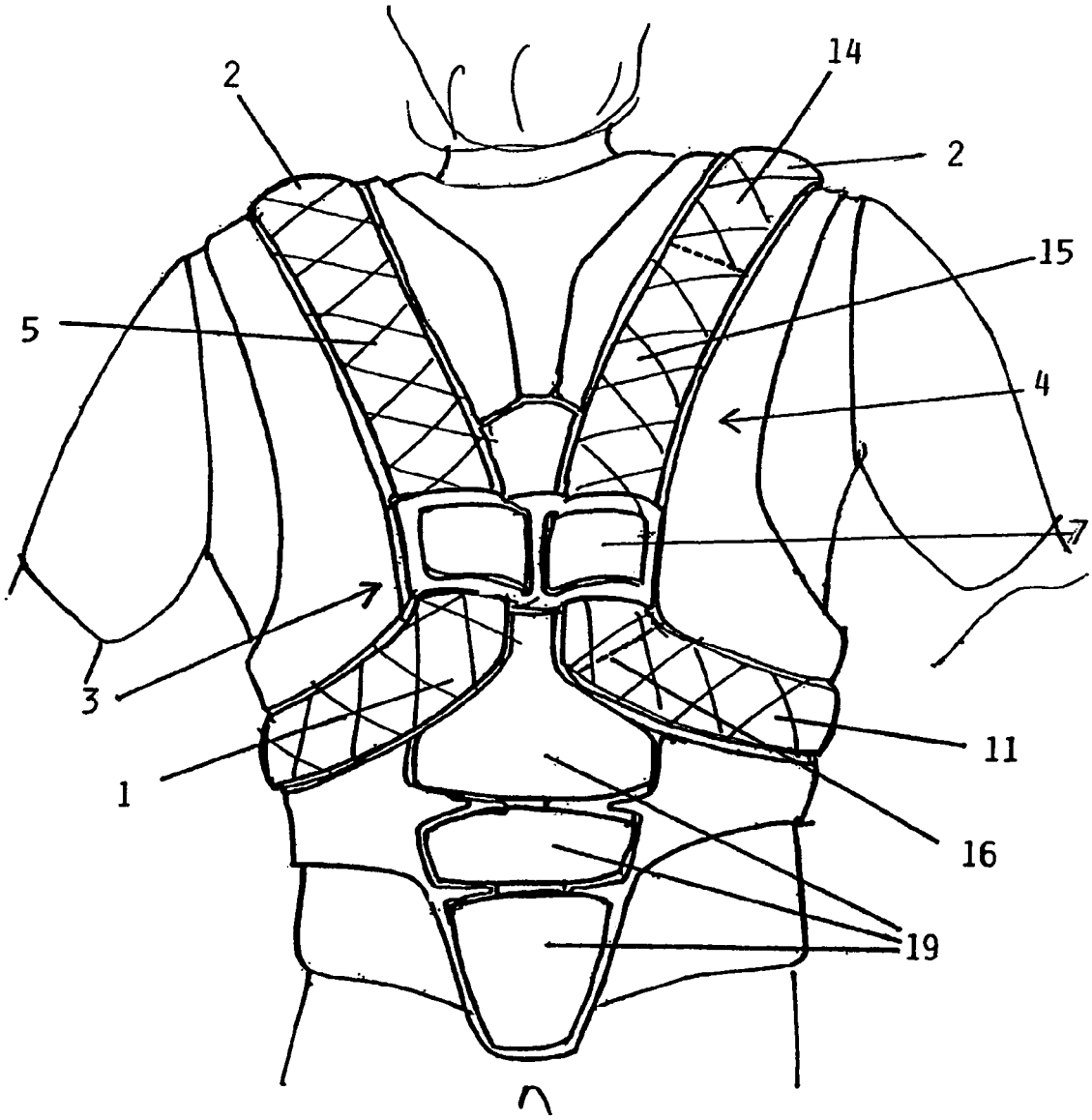

Referring now to the figures of the drawing in detail and first, particularly, to FIGS. 1A and 1B thereof, there is shown a front view and a rear view of an embodiment of an upper body protector as can be used, for example, by riders. According to the invention, the upper body protector for protecting persons from compression trauma is composed of rigid protection elements 1 and shoulder supports 2 which together each form a cage part 3 protecting the left side of the upper body protector and a cage part 4 protecting the right side of the upper body. The cage parts 3 and 4 are formed by at least one tubular body 5 made of fiber-reinforced plastic. Even though the fiber-reinforced plastics are very rigid, they have a certain elasticity by means of which impaction forces can be taken up into the structure and distributed. Through the continuous structure of the protection elements 1 and shoulder supports 2 and through the use of fiber-reinforced plastic and the particular design of the upper body protector, a particularly high degree of protection from compression is achieved. The left and right cage parts 3, 4 are releasably connected to one another at the connection points on the front by way of closure elements 6. These closure elements 6 can be formed by straps, clasps or the like. At the connection point of the cage parts 3, 4 on the back of the upper body protector, closure elements can likewise be arranged for releasable connection, or also one or more hinges 7. Such a hinge 7 can, for example, be formed by a strap formed in a figure eight.

Figure 2A:
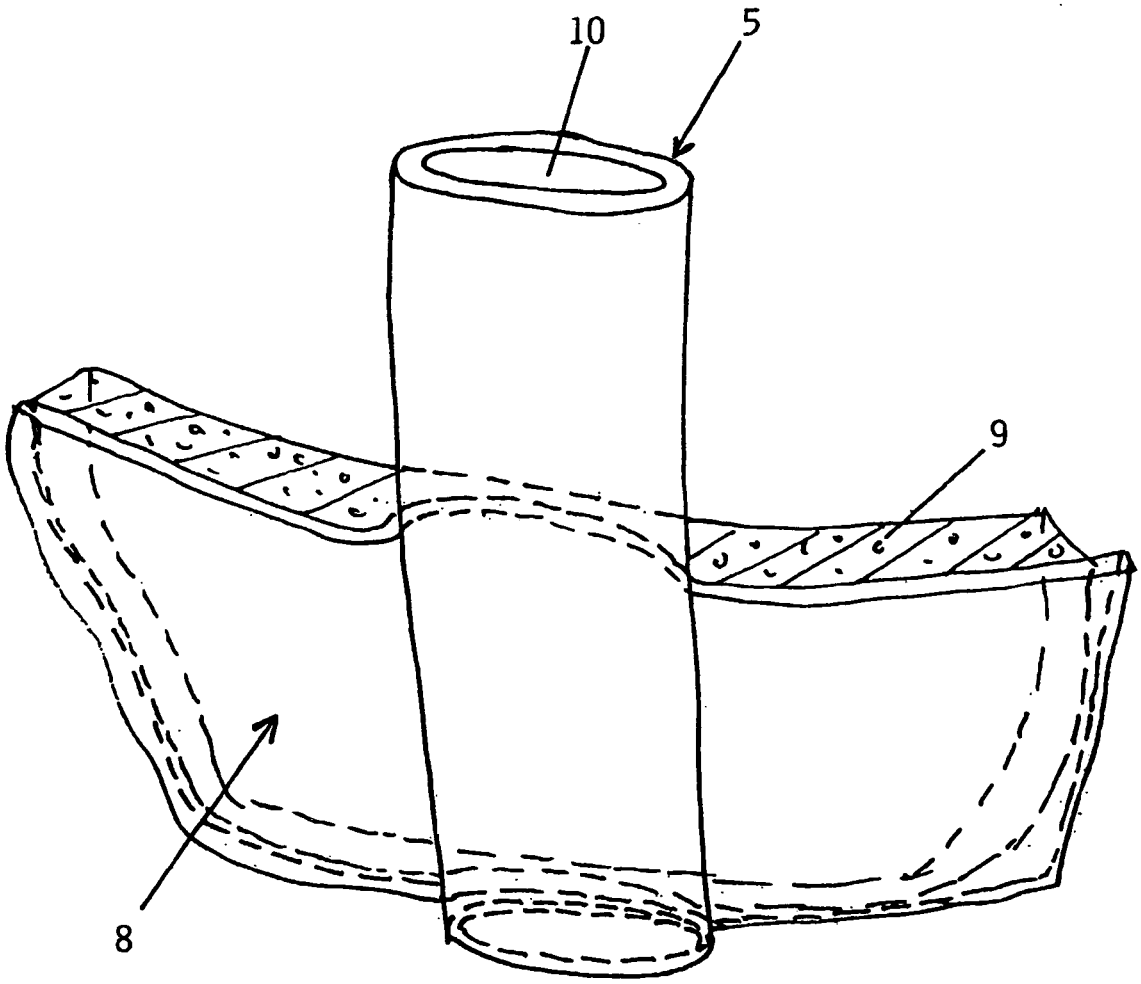
FIGS. 2A and 2B show partial views of the protector according to FIGS. 1A and 1B, with the tubular body shown in cross section and in two variants.

The cage parts 3, 4 formed from the tubular body 5 can be embedded in a plastic shell 8, and a cushioning layer 9 of foam material or the like is arranged on the side directed toward the body in the use position. This can be better seen from the detail according to FIG. 2A. Moreover, the tubular body 5 has an oval cross section giving a high degree of stability and wearing comfort. Such an upper body protector can protect a rider from a horse falling on top of him and withstands a weight of over a metric ton. This is achieved by the cage-like structure of the protector, which affords an especially stable structure. An important aspect is that a load does not cause lateral shifting of the cage parts 3, 4 relative to one another. This must be ensured by suitable closure elements 6 or hinges 7.

Figure 2B:
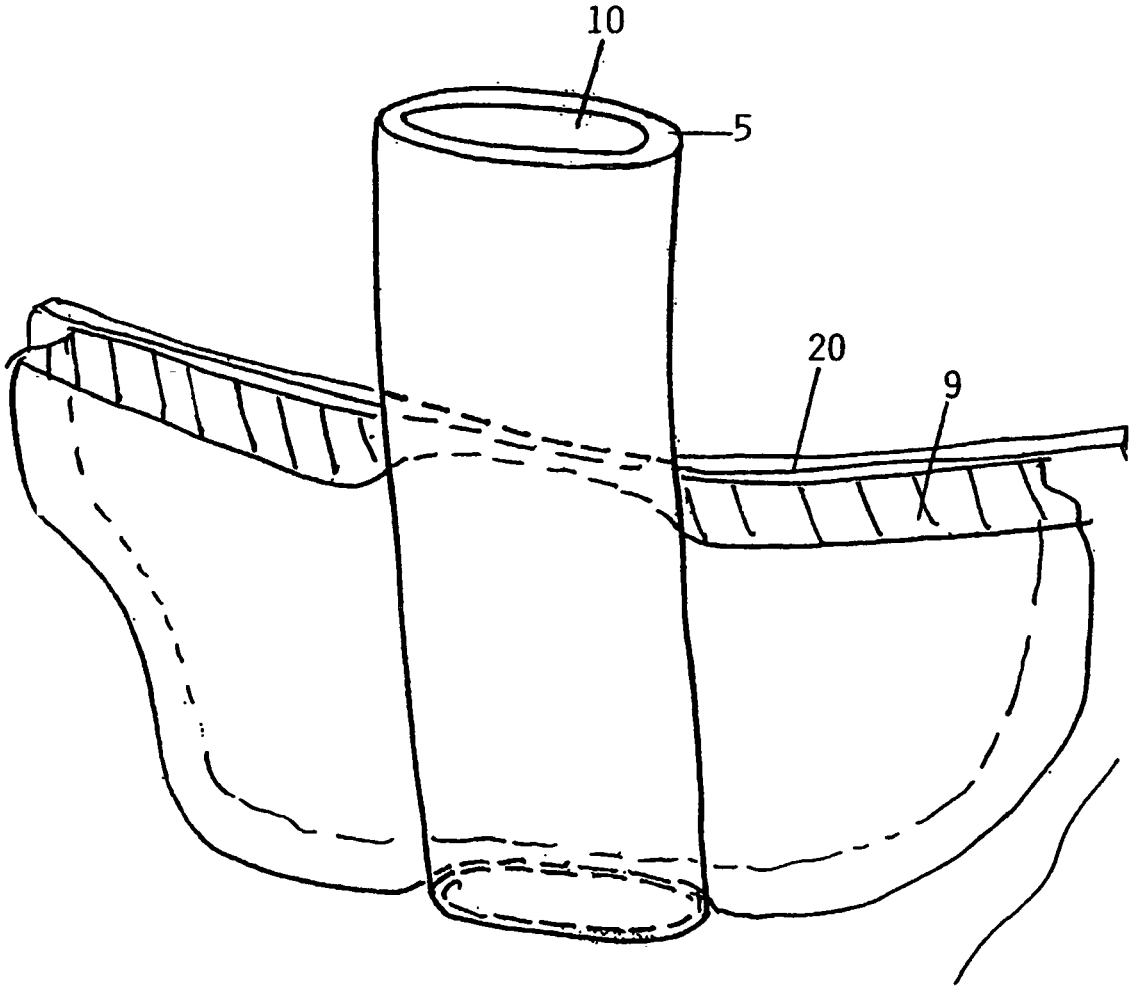

FIG. 2B shows a variant in which a cushioning layer 9 is arranged on the side directed toward the upper body in the use position and has a layer of fabric 20 arranged underneath it.

Figure 6:
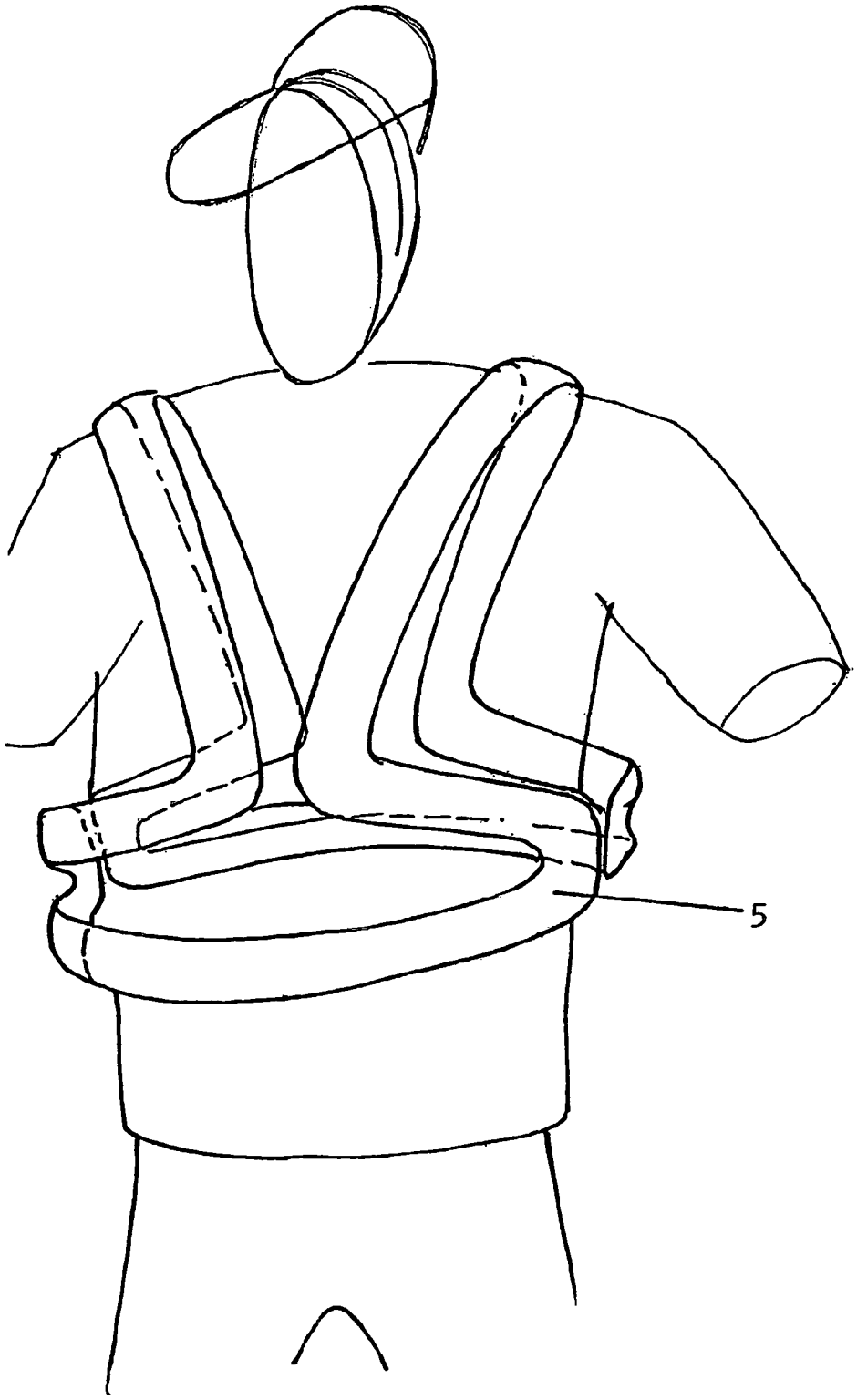
FIG. 6 shows a perspective view of a one-piece upper body protector.

It is also possible for the protector to be produced in one piece, see FIG. 6, in which case, however, a tight fit to the body is not obtainable because it has to be possible to pull the protector on and off by providing suitably large openings for the arms and head. By contrast, a two-piece or multi-piece embodiment of the upper body protector can offer a greater accuracy of fit. The tubular body 5 can comprise a core 10 which can be formed, for example, by a foam material or the like, around which, during production, the resin-impregnated fiber fabric, for example glass fiber fabric or carbon fiber fabric, is wound, and thereafter subjected to hardening by heat and pressure. It is likewise possible to form the core 10 from a plastically deformable material, for example aluminum, and thus construct the upper body protector and then, by winding the core 10 with the resin-impregnated fabric and hardening the structure, give said structure a suitable strength.

In the upper body protector according to FIG. 1, each cage part 3, 4 is composed of a half tire 11 which, in the use position, extends in the lower rib region from the back to the front of the upper body and whose front end 12 is connected to the shoulder support 14 via a connecting bridge 13 arranged alongside the sternum, which shoulder support part 14 is connected to the other end 16 of the half tire 11 via a connecting bridge 15 extending on the back alongside the spinal column. The areas are indicated by broken lines on the right cage part 4. Of course, a wide variety of modifications of such a construction are possible. FIG. 1B also shows plastic parts 19 which can be attached to the tubular body 5 and provide protection, for example for the spinal column.

Figure 3:
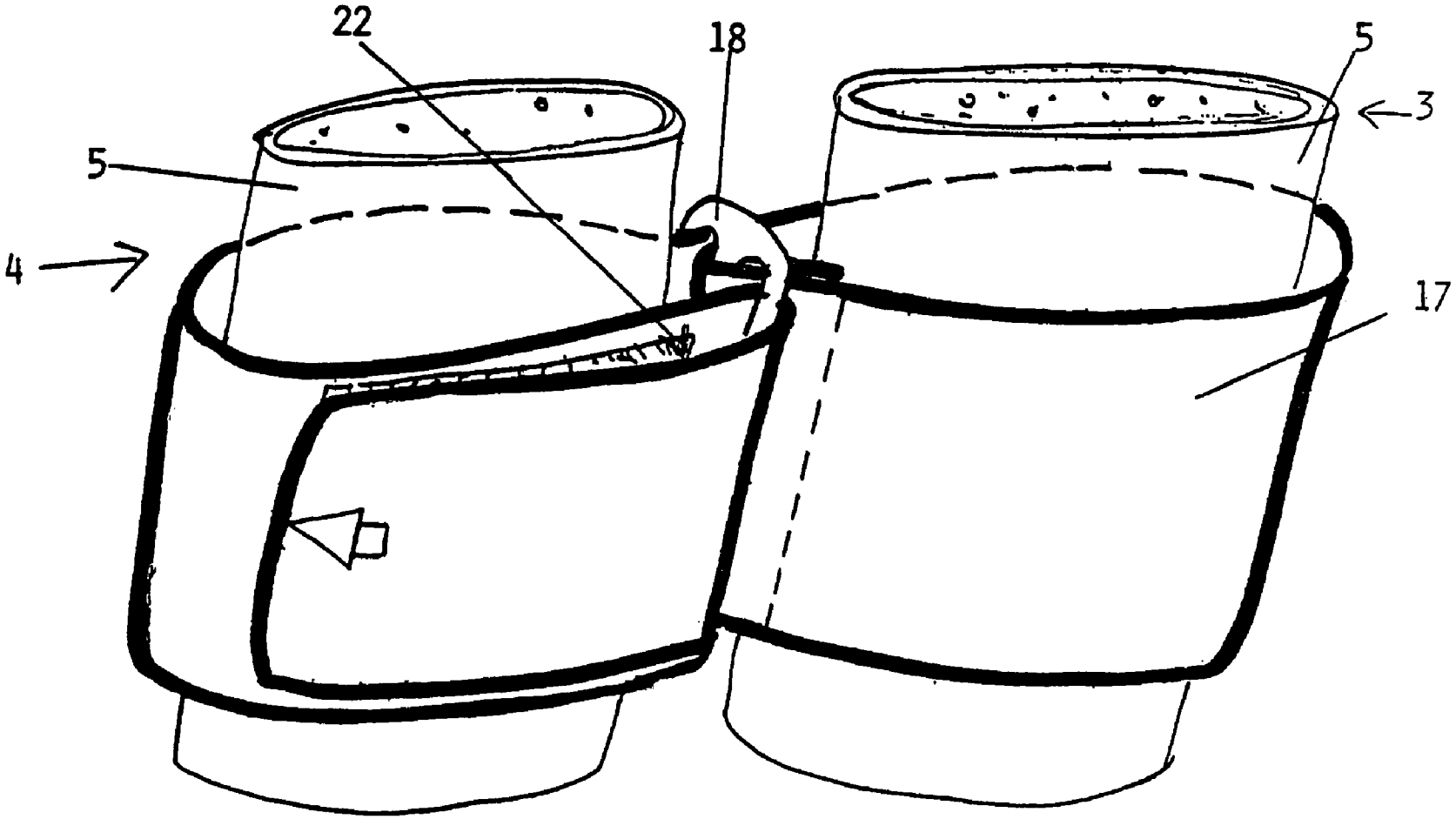
FIG. 3 shows a cross-sectional view through the protector in the area of a connection point.

FIG. 3 is a schematic cross section through the cage parts 3, 4 in the area of a connection point on the front, where the two tubular bodies 5 forming the cage parts 3 and 4 are surrounded by a strap 17 which is secured via a corresponding clasp 18 or the like. The strap 17 can be fixed, for example, by way of a hook-and-loop (e.g., Velcro®) closure 22. In this way, both a hinge 7 and a releasable closure element 6 can be constructed, and a secure connection of the tubular bodies 5 of the left and right cage parts 3, 4 can be achieved. By means of suitable formations, for example teeth, at the connection point, displacements perpendicular to the surface of the upper body can be avoided, so as to reliably avoid compression of the upper body. This represents just one embodiment of a closure element 6 or hinge 7, and other constructions are also possible.

Figure 4:
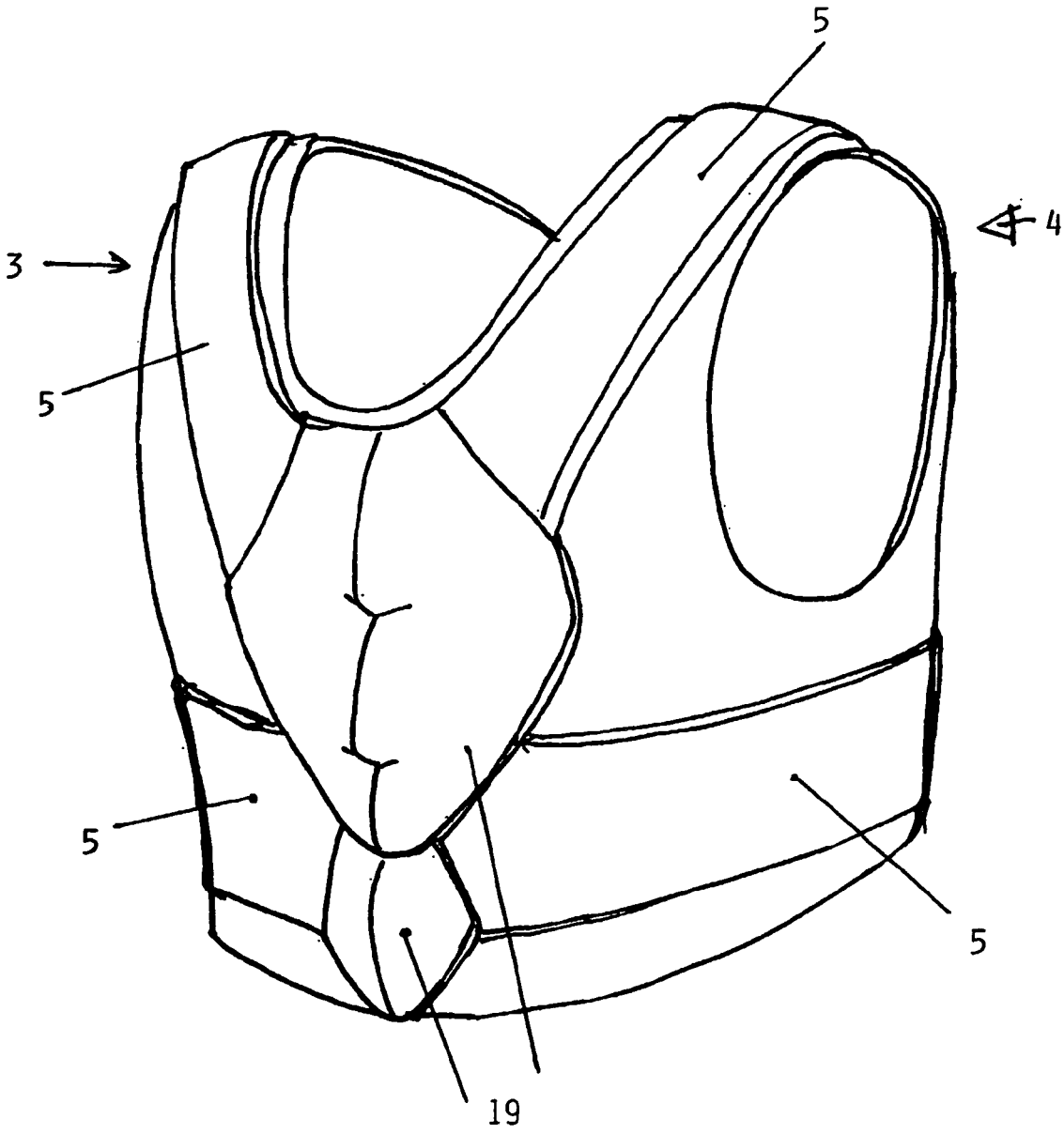
FIG. 4 shows a view of a further embodiment of an upper body protector from behind.

Finally, FIG. 4 shows a perspective view of a further variant of an upper body protector, seen toward the back, and additional plastic parts 19 for protecting the spinal column are attached to the tubular bodies 5 forming the right and left cage parts 3, 4. The plastic parts 19 can be made by injection molding of thermoplastics. In this way, the shoulder regions or other areas of the upper body can also be protected.

Figure 5:
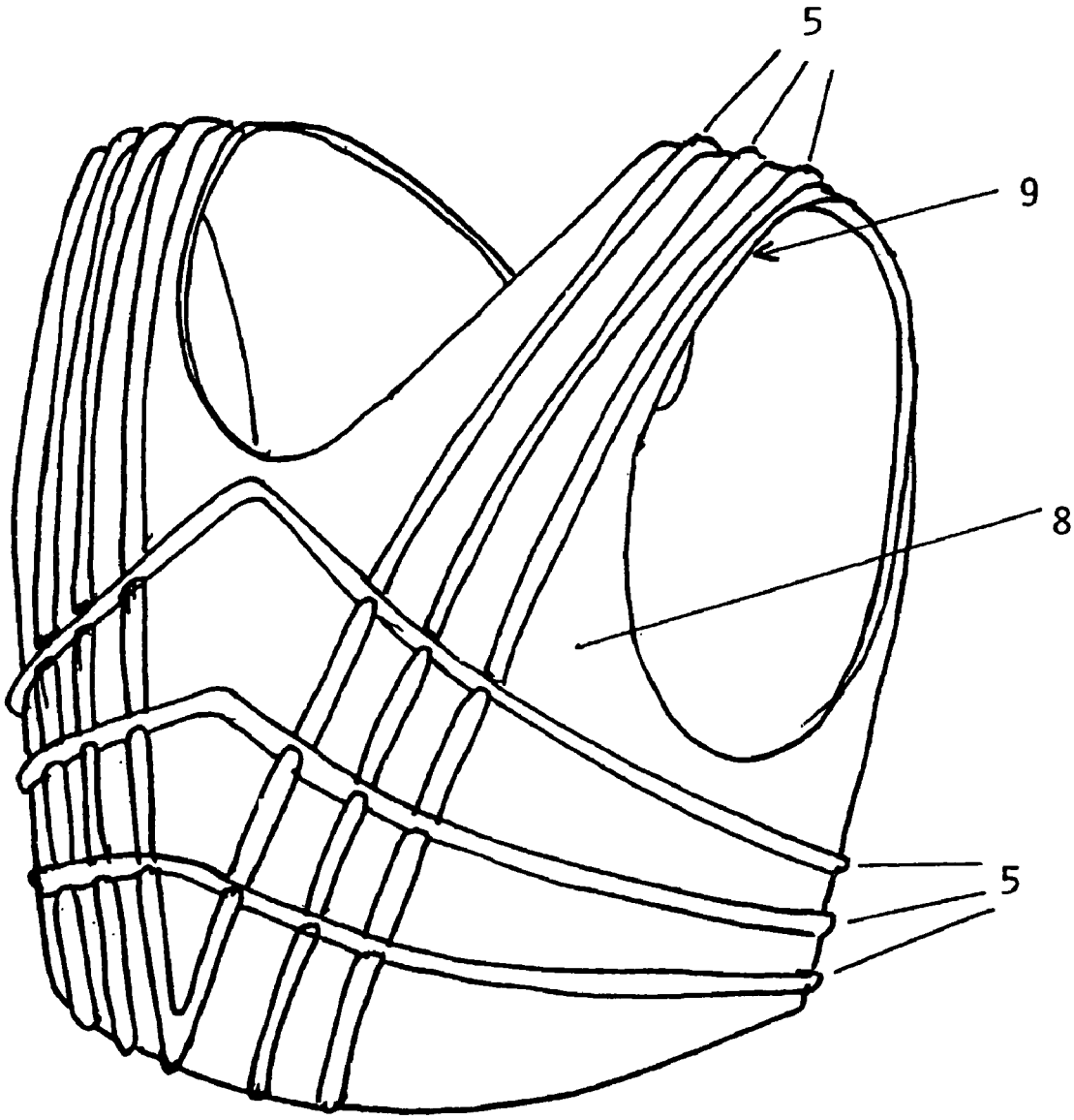
FIG. 5 shows a further embodiment of an upper body protector.

FIG. 5 shows a perspective view of a further embodiment of an upper body protector in which many tubular bodies 5 are used to form the cage-like structure of the protector. The tubular bodies 5 are advantageously incorporated or embedded in a plastic shell 8 which has a cushioning layer 9, for example of foam material, on the side directed toward the upper body in the use position. A layer of fabric (not shown) can be arranged on the side of the plastic shell 8 directed away from the upper body in the use position.

FIG. 6 shows a perspective diagrammatic view of an upper body protector composed of one piece, which is made up of one or more tubular bodies 5.

Figure 7:
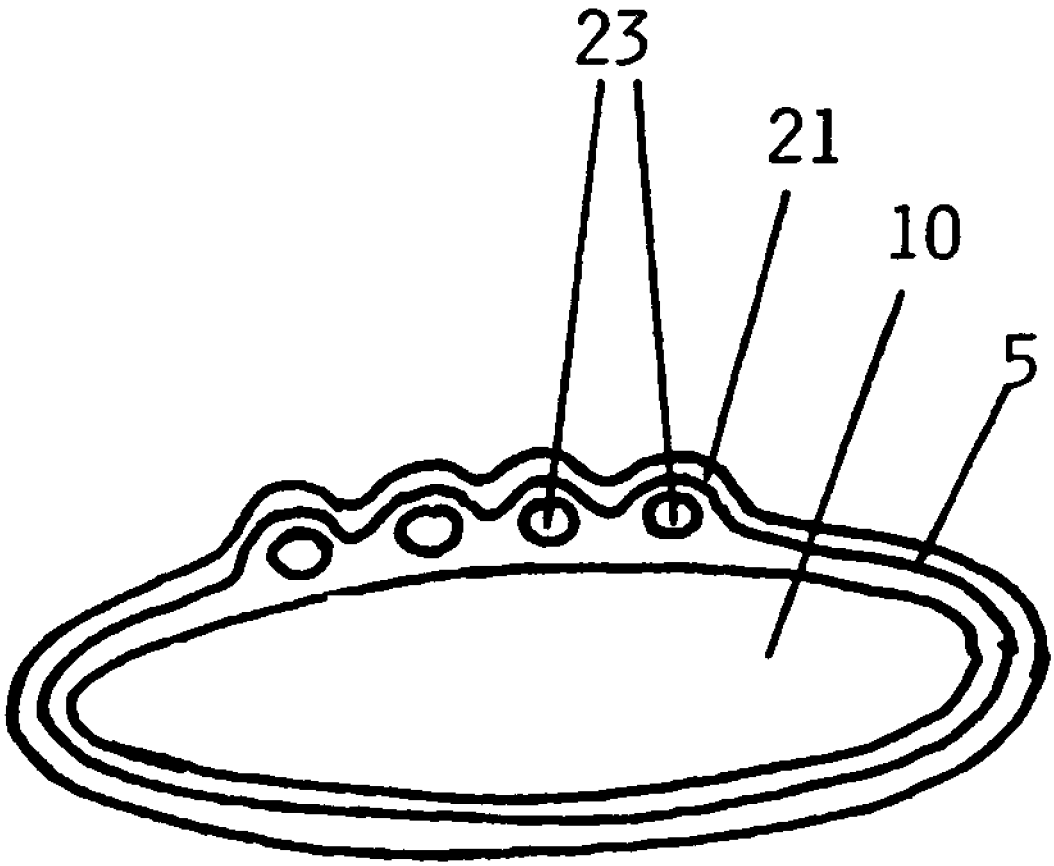
FIG. 7 shows a sectional drawing of a tubular body with surface structures intended to provide increased strength.

Finally, FIG. 7 shows a sectional drawing of a tubular body 5 whose surface comprises structures intended to provide increased strength, for example ribs 21. By means of such structures for providing increased strength, the stability can be improved at least in the area of certain connection points. Elements 23 for increased strength can be incorporated underneath the structures, for instance the ribs 21.

It will be understood by those of skill in the art that the construction of the upper body protector can be modified in a wide variety of ways. Likewise, its application is not limited to the aforementioned riders or motorcyclists or construction workers, and instead the upper body protector can be used in all sectors where persons are exposed to increased risk of compression of the upper body.

We claim:

1. An upper body protector for protecting a person from compression trauma, comprising:

substantially rigid protection elements and shoulder supports together forming two continuous cage parts to be arranged mirror-symmetrically about a vertical plane of symmetry of the person to be protected;

said cage parts extending from a front of an upper body to a back of the upper body and being connected to one another in a use position; and each of said cage parts being formed of a one-piece, substantially rigid, continuous structure of fiber-reinforced plastic.

2. The upper body protector according to claim 1, wherein each of said cage parts includes at least one tubular body.

3. The upper body protector according to claim 2, wherein said tubular body has a substantially flat cross section.

4. The upper body protector according to claim 3, wherein said tubular body has an oval cross section.

5. The upper body protector according to claim 2, wherein said tubular body comprises a core and a fiber-reinforced plastic disposed around said core.

6. The upper body protector according to claim 5, wherein said core is formed of foam material.

7. The upper body protector according to claim 5, wherein said core is made of a plastically deformable material of relatively light weight.

8. The upper body protector according to claim 7, wherein said core is made of aluminum.

9. The upper body protector according to claim 1, which further comprises connection elements releasably connecting said two cage parts to one another at at least one connection point.

10. The upper body protector according to claim 9, wherein said closure elements are disposed in the front.

11. The upper body protector according to claim 9, which further comprises a hinge connecting said two cage parts to one another at a connection point in the back.

12. The upper body protector according to claim 1, wherein said cage parts are formed with means for avoiding mutual displacement thereof at the connection points.

13. The upper body protector according to claim 1, wherein said cage parts are two symmetrical cage parts respectively provided for a right side and a left side of the upper body, wherein each cage part is formed by a half tire which, in the use position, extends in a lower rib region from the back to the front of the upper body and whose front end is connected to a shoulder support via a connecting bridge disposed alongside a sternum of the person, and wherein said shoulder support is connected to the other end of the half tire via a connecting bridge extending on the back alongside a spinal column of the person.

14. The upper body protector according to claim 1, which further comprises at least one first body of fiber-reinforced plastic extending along an abdomen region and at least one second body of fiber-reinforced plastic extending along a lower back region, said first body and said second body connecting said two cage parts to form a one-piece protector.

15. The upper body protector according to claim 1, which further comprises a cushioning layer at each of said cage parts, said cushioning layer being disposed at least on a side directed toward the upper body in the use position.

16. The upper body protector according to claim 15, wherein said cushioning layer is formed of foam material.

17. The upper body protector according to claim 15, wherein said cage part and said cushioning layer are encased by a covering.

18. The upper body protector according to claim 1, wherein said cage parts are formed of plastic with reinforcing carbon fibers.

19. The upper body protector according to claim 1, which further comprises additional plastic parts attached to at least one of said cage parts.

20. The upper body protector according to claim 19, wherein said additional plastic parts are disposed for protecting a shoulder and a spinal column of the person to be protected.

21. The upper body protector according to claim 2, wherein said tubular body includes, at least in some places, surface structures intended to provide increased strength.

22. The upper body protector according to claim 21, wherein said surface structures are ribs.

23. The upper body protector according to claim 2, wherein said tubular body is incorporated into a plastic shell, and wherein a side of said plastic shell directed toward the upper body in the use position is provided with a cushioning layer.

24. The upper body protector according to claim 23, wherein said cushioning layer is formed of foam material.

25. The upper body protector according to claim 23, which comprises a layer of fabric encasing a side of said plastic shell directed away from the upper body in the use position.

* * * * *